US005870065A

United States Patent [19]

Kanba et al.

[11] Patent Number: 5,870,065

[45] **Date of Patent: *Feb. 9, 1999**

[54] CHIP ANTENNA HAVING DIELECTRIC AND MAGNETIC MATERIAL PORTIONS

[75] Inventors: Seiji Kanba, Otsu; Teruhisa Tsuru, Kameoka; Kenji Asakura, Shiga-ken; Tsuyoshi Suesada, Omihachiman; Harufumi Mandai, Takatsuki, all of Japan

[73] Assignee: Murata Mfg Co. Ltd., Kyoto, Japan

[ * ] Notice: The term of this patent shall not extend beyond the expiration date of Pat. No. 5,596,301.

[21] Appl. No.: 729,820

[22] Filed: Oct. 8, 1996

[30] Foreign Application Priority Data

Dec. 8, 1995 [JP] Japan ..... 7-320254

[51] Int. Cl.[6] ..... H01Q 1/36

[52] U.S. Cl. ..... 343/895; 343/787; 343/873

[58] Field of Search ..... 343/702, 787, 343/895, 700 MS, 788, 873; H01Q 1/36, 1/38

[56] References Cited

U.S. PATENT DOCUMENTS

| | | | |
|---|---|---|---|
| 3,310,807 | 3/1967 | Kofoid | 343/787 |
| 4,012,738 | 3/1977 | Wright . | |
| 4,598,276 | 7/1986 | Tait | 343/895 |
| 4,600,018 | 7/1986 | James et al. | 343/787 |
| 5,327,148 | 7/1994 | How et al. | 343/787 |
| 5,515,059 | 5/1996 | How et al. | 343/787 |
| 5,589,842 | 12/1996 | Wang et al. | 343/787 |

FOREIGN PATENT DOCUMENTS

| | | |
|---|---|---|
| 0554486 | 8/1993 | European Pat. Off. . |
| 063068 | 12/1994 | European Pat. Off. . |
| 0759646 | 2/1997 | European Pat. Off. . |
| 2013037 | 8/1979 | United Kingdom . |

*Primary Examiner*—Don Wong
*Assistant Examiner*—Tho Phan
*Attorney, Agent, or Firm*—Ostrolenk, Faber, Gerb & Soffen, LLP

[57] ABSTRACT

A miniature chip antenna which can be utilized as an antenna for use in a high-frequency region is provided. The chip antenna comprises a substrate, at least one conductor, and at least one feeding terminal. The substrate comprises a dielectric material portion and a magnetic material portion, at least a part of the magnetic material portion being exposed to the exterior of the substrate. The conductor is formed at least either on the surface of the substrate or inside the substrate. The feeding terminal is provided on the surface of the substrate to impress a voltage on the conductor.

56 Claims, 6 Drawing Sheets

CHIP ANTENNA HAVING DIELECTRIC AND MAGNETIC MATERIAL PORTIONS

BACKGROUND OF THE INVENTION

1. Field of the Invention

The present invention relates to a chip antenna, and more specifically, to a chip antenna used for mobile communication equipment for mobile communication and local area networks (LAN).

2. Description of the Related Art

FIG. 10 is a side elevational view of a conventional chip antenna. The conventional chip antenna 50 comprises an insulator 51 which has a rectangular parallelopiped shape and consists of a lamination of insulator layers (not shown in the figure) comprising powders of insulating material such as alumina, steatite and/or the like, a conductor 52 which consists of silver, silver-palladium and/or the like and is provided inside of the insulator 51 in the form of a coil, a magnetic member 53 which consists of a powder of insulating material such as an amorphous metal powder and is provided inside of the insulator 51 and the coil conductor 52, and external connecting terminals 54*a* and 54*b* which are applied and/or printed at the drawing terminals (not shown in the figure) of the conductor 52 subsequent to heating of the insulator 51. In other words, the chip antenna 50 comprises the magnetic member 53 around which the conductor 52 is coiled, and which is embedded in the insulator 51.

In conventional chip antennas as described above, a magnetic member having a high permeability, such as an amorphous metal magnetic member, is placed in the coil conductor and embedded with the insulator in order to enhance the inductance value of the conductor, and by means of which the chip antenna has been miniaturized.

However, the value of the Q factor of the amorphous metal magnetic member deteriorates in a high-frequency region and the value of the loss factor increases by using a structure in which an amorphous metal magnetic member of high permeability is placed in the coil conductor and embedded with the insulator. For such reasons relative to the characteristics, conventional chip antennas are rarely utilized as antennas in high-frequency regions.

The present invention has been accomplished to solve the above-described problems.

SUMMARY OF THE INVENTION

Accordingly, an object of the present invention is to provide a miniature chip antenna which can be utilized even as an antenna for use in a high-frequency region.

The above and other objects of the invention are achieved by a chip antenna comprising a substrate, at least one conductor, and at least one feeding terminal, wherein the substrate comprises a dielectric material portion and a magnetic material portion, at least a part of the magnetic material portion being exposed to the exterior of the substrate; the conductor being formed at least one of on the surface of the substrate and inside the substrate; and the feeding terminal being provided on the surface of the substrate to impress a voltage on the conductor.

Such a chip antenna as characterized above can be used in a higher-frequency region as compared with a conventional chip antenna.

Further, another aspect of the present invention is to achieve a chip antenna as set forth above, wherein the conductor is provided only in a dielectric material portion of the substrate.

According to this aspect, the line length of the conductor can be shortened by utilizing the wavelength-shortening effect of the dielectric material. As a result, the chip antenna can be miniaturized. Accordingly, when the miniaturized chip antenna is applied, for example, in equipment for mobile communication, the chip antenna equipment can be built into the equipment, and in addition, the equipment itself can be miniaturized.

Additionally, since the magnetic material portion which does not contain the conductor has a radio-wave-absorbing effect, the gain decreases in the direction where the portion exists. As a result, directivity of the antenna can be controlled. In particular, when the antenna is applied in a mobile cellular phone or the like, any adverse effect of radio waves on the human body can be prevented by providing such a portion comprising a magnetic material on the side close to the human body.

Moreover, another aspect of the present invention is to achieve the chip antenna as set forth above, wherein the conductor is provided only in the magnetic material portion of the substrate.

According to this aspect, the inductance value of the conductor can be made large. As a result, the chip antenna can be miniaturized.

In addition, an impedance matching circuit can be provided in the dielectric material portion which does not contain the conductor. As a result, the bandwidth ratio can be made large.

Furthermore, another aspect of the present invention is the chip antenna as set forth above, wherein the conductor is provided so as to be contained in both of the dielectric material portion and the magnetic material portion.

Such a chip antenna possess a combination of different antenna characteristics. Accordingly, a chip antenna capable of having a plurality of resonance frequencies can be obtained.

In the chip antenna of the present invention, magnetic materials having excellent high-frequency characteristics, namely, magnetic materials of low permeability, can be used, since the substrate comprises a dielectric material portion and a magnetic material portion, and the magnetic material portion is partly exposed to the exterior of the substrate. Therefore, deterioration of the value of the Q factor can be prevented and a miniature antenna for the use in a high-frequency region can be obtained according to the present invention.

Other features and advantages of the present invention will become apparent from the following description of the invention which refers to the accompanying drawings.

DETAILED DESCRIPTION OF EMBODIMENTS OF THE INVENTION

Figure 1:
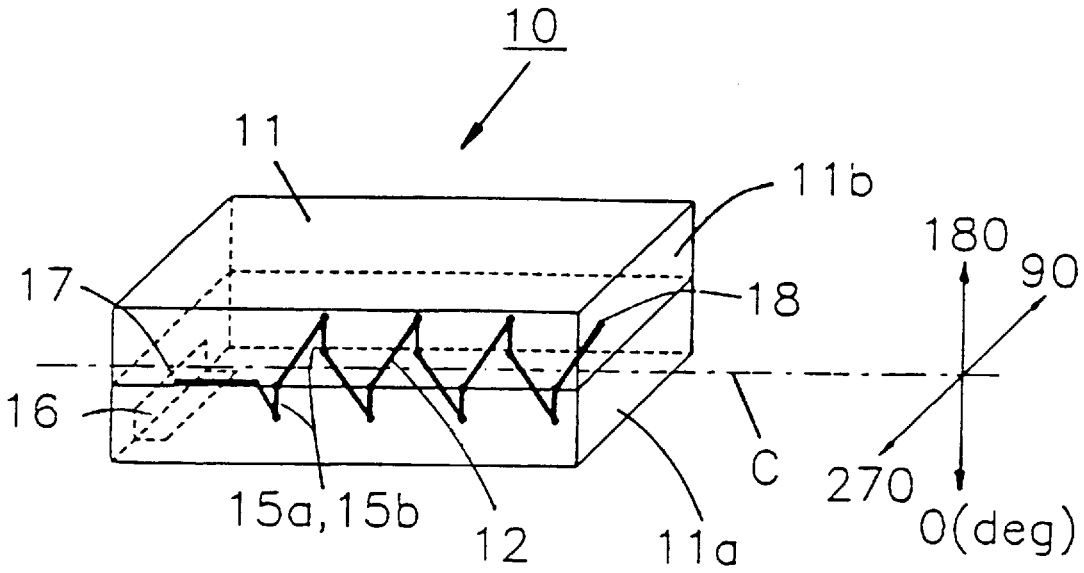
FIG. 1 is an isometric view illustrating a chip antenna of Example 1 in accordance with the present invention.

Referring to the drawings, the present invention will now be illustrated in detail with some examples. Here, portions and items in each example, when they are the same as or similar to those of Example 1, are indicated with the same number as in Example 1, and further, detailed explanations thereof are not repeated.

Figure 2:
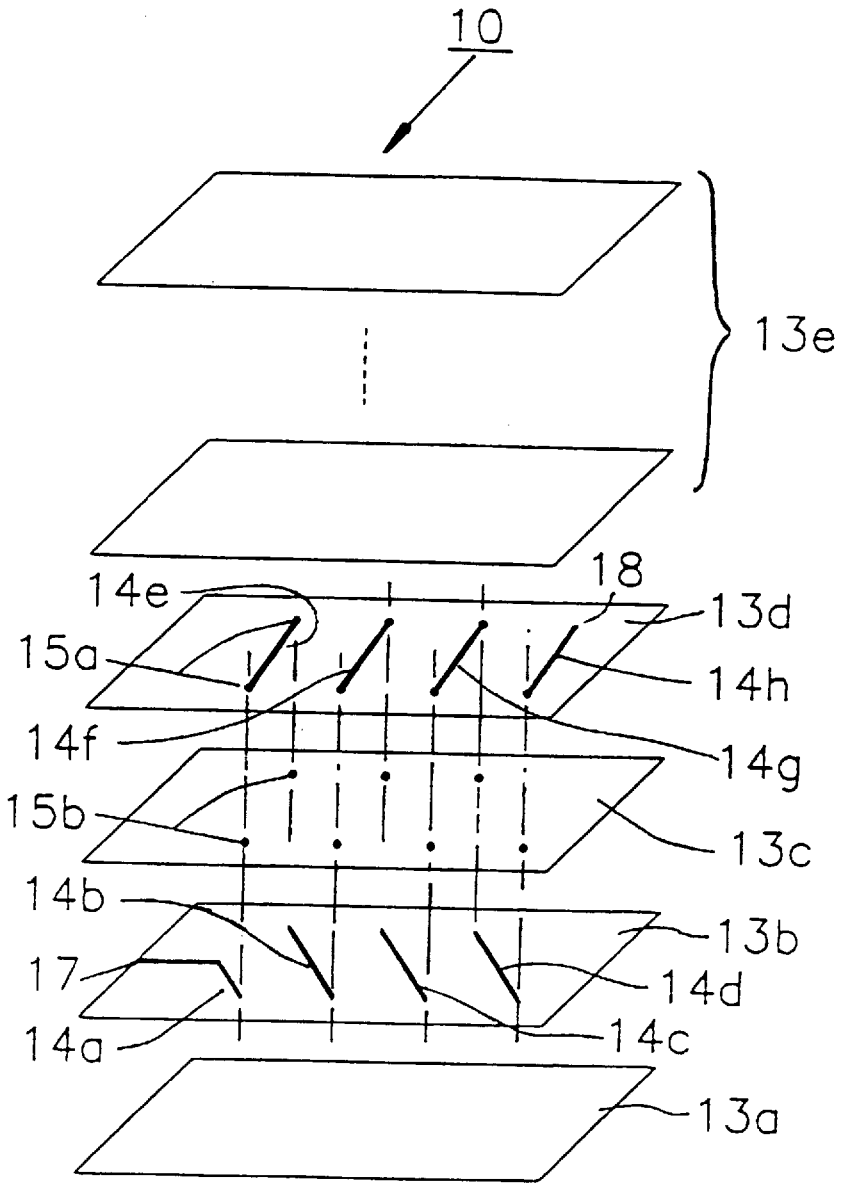
FIG. 2 is a decomposed isometric view of the chip antenna shown in FIG. 1.

FIGS. 1 and 2 are an isometric view and a decomposed isometric view, respectively, illustrating a chip antenna of Example 1 in accordance with the present invention.

The chip antenna 10 of Example 1 comprises a rectangular parallelopiped substrate 11 which comprises a dielectric material portion 11*a* and a magnetic material portion 11*b*, and inside of the substrate 11 is provided a conductor 12 spirally coiled in the longitudinal direction of the substrate 11. Here, the dielectric material portion 11*a* is a lamination of rectangular sheet-layers 13*a*–13*d* comprising dielectric materials (dielectric constant=6, No. 1 in Table 1) which principally consist of barium oxide, aluminum oxide and silica as described in Table 1. On the other hand, the magnetic material portion 11*b* is a lamination of a plurality of rectangular sheet-layers 13*e* comprising a magnetic material (permeability=20, No. 3 in Table 1) which principally consists of nickel oxide, zinc oxide, cobalt oxide and iron oxide as described in Table 1. In the structure of Example 1, the magnetic material portion 11*b* is placed in the direction of 180 degrees in terms of the coordinate shown in FIG. 1, the plane of which is perpendicular to the axis C for coiling the conductor 12, and the magnetic material portion 11*b* is partly exposed to the exterior of the substrate 11.

TABLE 1

| No. | Composition | Dielectric Constant | Q.f | Relative Permeability | Critical Frequency |
|---|---|---|---|---|---|
| 1 | Ba—Al—Si—O | 6 | 2000 | — | — |
| 2 | Ni/Zn/Co/Fe/O | — | — | 5 | 360 MHz |
| 3 | Ni/Zn/Co/Fe/O | — | — | 20 | 70 MHz |

In Table 1, "Q f" indicates the product of the Q factor and the measured frequency, and is almost specific to the material which is used. Further, "Critical Frequency" is the frequency where the value of the Q factor decreases to the half value of the Q factor in the low-frequency region in which the Q factor is almost constant. "Critical Frequency", therefore, indicates the upper limit of the frequency where the material is available.

Among the sheet-layers 13*a*–13*e* constituting the dielectric material portion 11*a* and the magnetic material portion 11*b*, the sheet-layers 13*b* and 13*d* are provided with conductive patterns 14*a*–14*h* on their surfaces by printing, deposition, adhesion, or plating, etc. Each of the conductive patterns comprises, e.g., copper or a copper alloy, and preferably has an L-shape or a linear shape. The sheet layer 13*d* is also provided with via holes 15*a* at both ends of the conductive patterns 14*e*–14*g* and at one end of the conductive pattern 14*h*. Further, the sheet layer 13*c* is provided with via holes 15*b* at the corresponding positions of the via holes 15*a*, namely, the positions corresponding to one end of the conductive pattern 14*a* and both ends of the conductive pattern 14*b*–14*d*. Here, the via holes 15*a* and 15*b* are through holes created in the sheet layers 13*c* and 13*d* and filled with a conductive paste of silver.

The above-described sheet layers 13*a*–13*e* are stacked and heat-press-bonded. The conductive patterns 14*a*–14*h* are connected through the via holes 15*a* and 15*b* to form a conductor 12 which has a rectangular cross-section and which is spirally coiled only in the dielectric material portion 11*a*. After that, the substrate 11, inside of which the conductor 12 is provided, is heated at 900°–1000° C. for about 2 hours to obtain the chip antenna 10.

In the procedure, one end of the conductor 12 or the other end of the conductive pattern 14*a* is drawn out to the surface of the substrate 11 in order to form a feeding section 17 connecting with a feeding terminal 16 which is provided on the surface of the substrate 11 to impress a voltage on the conductor 12. On the other hand, the other end of the conductor 12 or the other end of the conductive pattern 14*h* constitutes a free end 18 inside of the dielectric material portion 11*a*.

Figure 3:
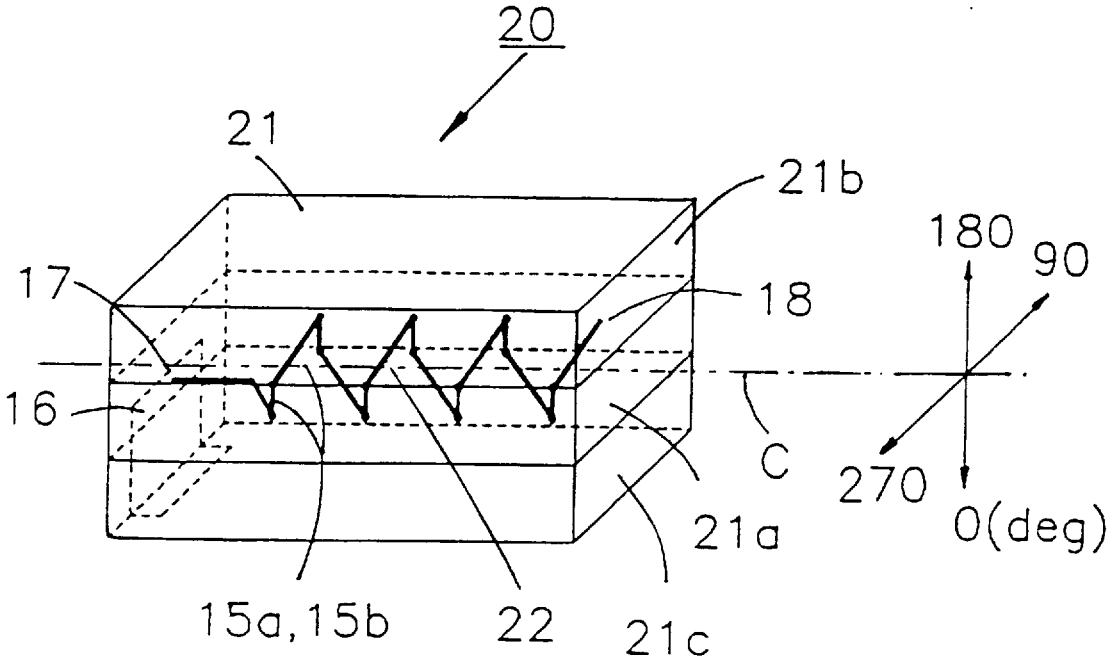
FIG. 3 is an isometric view illustrating a chip antenna of Example 2 in accordance with the present invention.

FIG. 3 is an isometric view illustrating a chip antenna of Example 2 in accordance with the present invention.

The chip antenna 20 of Example 2 comprises a rectangular parallelopiped substrate 21 which is composed of a dielectric material portion 21*a* and magnetic material portions 21*b* and 21*c*, wherein the dielectric material portion 21*a* is sandwiched with the magnetic material portions 21*b* and 21*c*. The portion 21*a* comprises a dielectric material (dielectric constant=6, No. 1 in Table 1) which principally contains barium oxide, aluminum oxide and silica. Further, the portion 21*b* comprises a magnetic material (permeability=20, No. 3 in Table 1) which principally contains nickel oxide, zinc oxide, cobalt oxide and iron oxide. Further, the portion 21*c* comprises a magnetic material (dielectric constant=5, No. 2 in Table 1) which principally contains nickel oxide, zinc oxide, cobalt oxide and iron oxide. In the structure of Example 2, the magnetic material portions 21*b* and 21*c* are placed in the direction of 0 degree and 180 degrees, respectively in terms of the coordinates shown in FIG. 2, the plane of which is perpendicular to the axis C for coiling a conductor 22, and each of the magnetic material portions 21*b* and 21*c* is partly exposed to the exterior of the substrate 21.

In addition, a conductor 22 is provided only in the dielectric material portion 21*a*, and is spirally coiled in the longitudinal direction of the substrate 21. Similar to the chip antenna 10 of Example 1, one end of the conductor 22 is drawn out to the surface of the substrate 21 in order to form a feeding section 17 connecting with a feeding terminal 16 which is provided on the surface of the substrate 21 to impress a voltage on the conductor 22. On the other hand, the other end of the conductor 22 constitutes a free end 18 inside of the dielectric material portion 21*a*.

Figure 4:
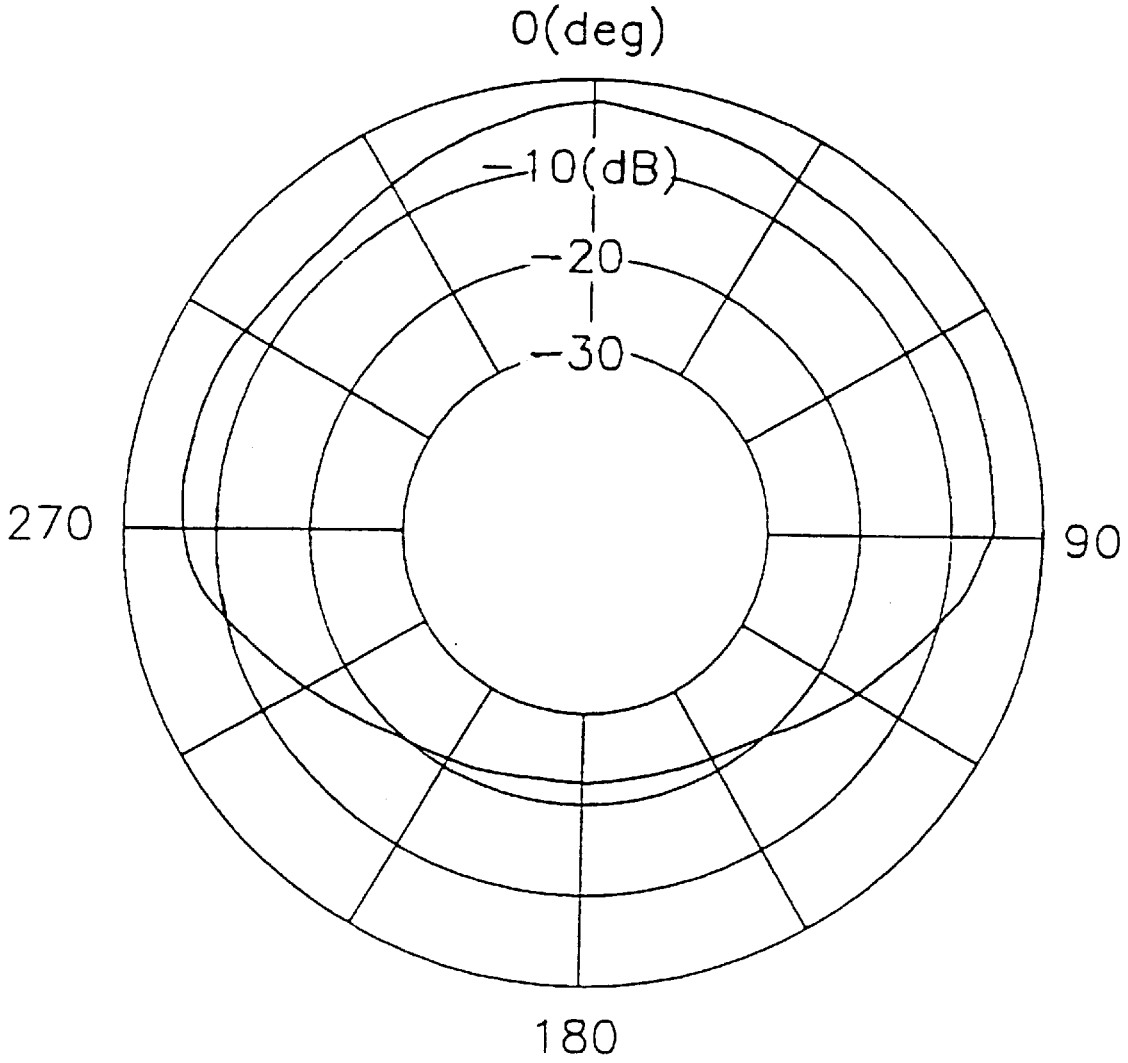
FIG. 4 is a diagram showing directivity of the chip antenna shown in FIG. 1.
Figure 5:
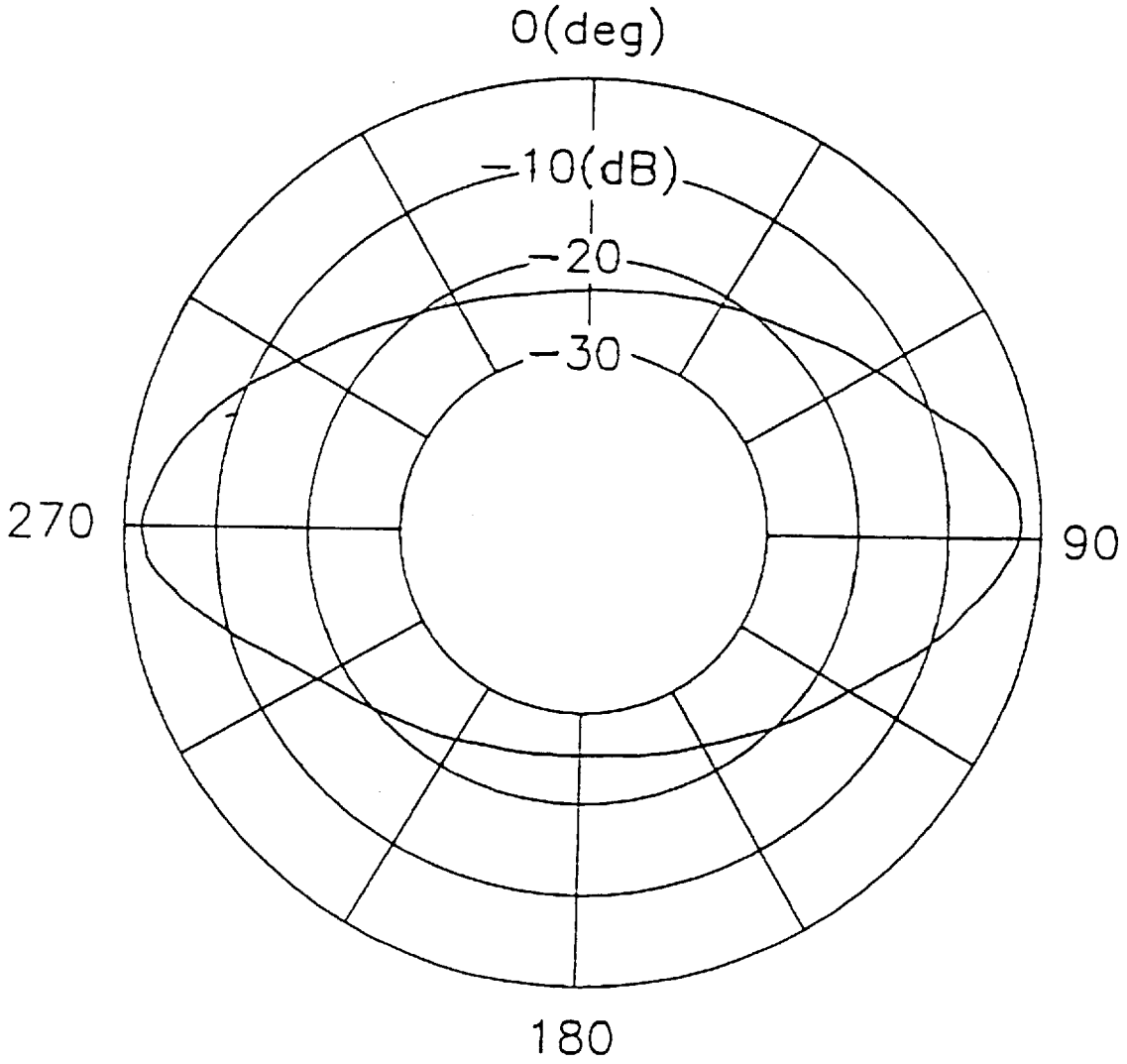
FIG. 5 is a diagram showing directivity of the chip antenna shown in FIG. 3.

FIGS. 4 and 5 are diagrams showing the directivity characteristics measured on the chip antennas 10 and 20, respectively, the center of each diagram being each axis for coiling. From the results shown in these diagrams, it is apparent that the gain decreases in the region of the magnetic material portion 11*b*, namely, in the direction of 0 degrees, and in the region where the magnetic material portions 21*b* and 21*c* exist, namely in the directions of 0 degrees and 180 degrees.

Figure 6:
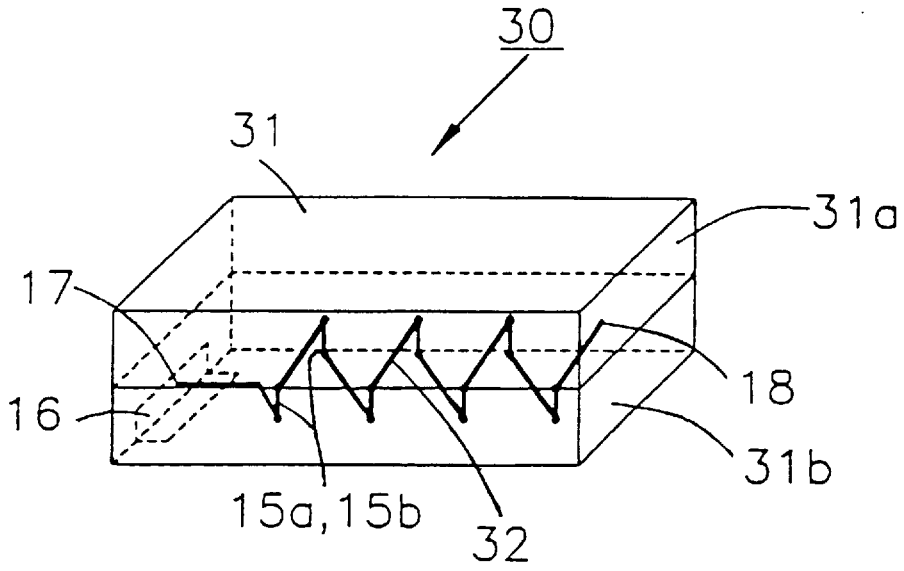
FIG. 6 is an isometric view illustrating a chip antenna of Example 3 in accordance with the present invention.

FIG. 6 is an isometric view illustrating a chip antenna of Example 3 in accordance with the present invention.

The chip antenna 30 of Example 3 comprises a rectangular parallelopiped substrate 31 consisting of a portion 31*a* which comprises a dielectric material (dielectric constant=6, No. 1 in Table 1) principally containing barium oxide, aluminum oxide and silica, and of a portion 31*b* which comprises a magnetic material (permeability=5, No. 2 in Table 1) principally containing nickel oxide, zinc oxide, cobalt oxide and iron oxide. In the structure of Example 3, the magnetic material portion 31*b* is partly exposed to the exterior of the substrate 31.

In addition, conductor 32 is provided only in the magnetic material portion 31*b*, and is spirally coiled in the longitudinal direction of the substrate 31. Similar to the chip antenna 10 of Example 1, one end of the conductor 32 is drawn out to the surface of the substrate 31 in order to form a feeding section 17 connecting with a feeding terminal 16 which is provided on the surface of the substrate 31 to impress a voltage on the conductor 32. The other end of the conductor 32 comprises a free end 18 inside of the magnetic material portion 31*b*.

Figure 7:
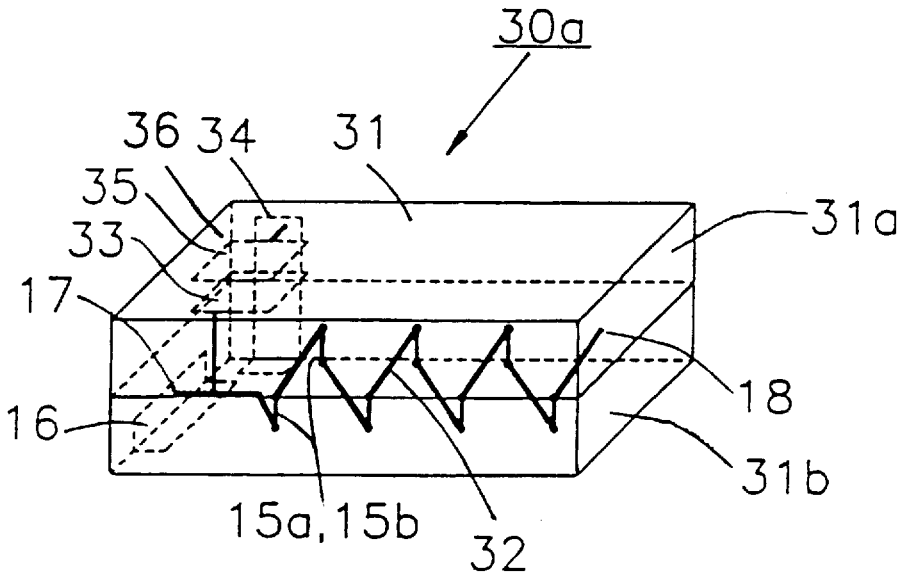
FIG. 7 is an isometric view illustrating a modified example of the chip antenna shown in FIG. 6.

FIG. 7 is an isometric view illustrating a chip antenna of a modified example based on Example 3.

As compared with the chip antenna 30 of Example 3, the modified chip antenna 30*a* differs in that an impedance matching circuit is provided in the dielectric material portion 31*a*. This impedance matching circuit is composed of a capacitor 36 comprising an electrode 33 which is connected with a feeding section 17 and an electrode 35 which is connected with an earth electrode 34.

Figure 8:
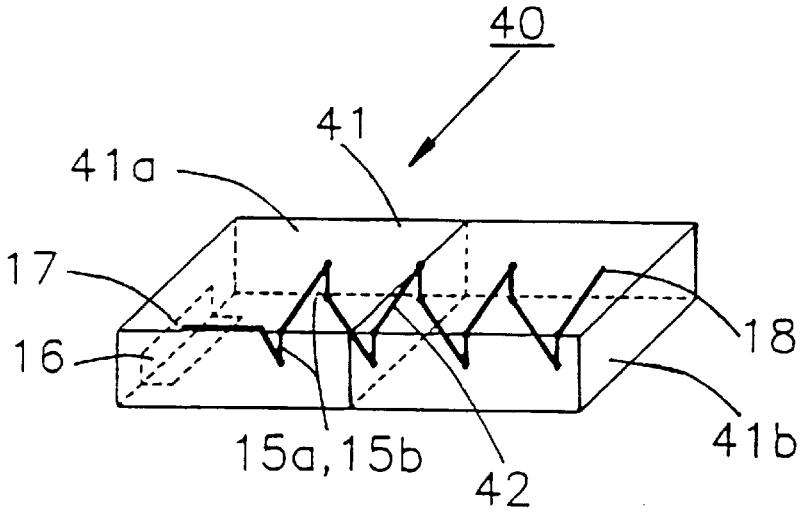
FIG. 8 is an isometric view illustrating a chip antenna of Example 4 in accordance with the present invention.

FIG. 8 is an isometric view illustrating a chip antenna of Example 4 in accordance with the present invention.

The chip antenna 40 of Example 4 comprises a rectangular parallelopiped substrate 41 consisting of a portion 41*a* which comprises a dielectric material (dielectric constant=6, No. 1 in Table 1) principally containing barium oxide, aluminum oxide and silica, and of a portion 41*b* which comprises a magnetic material (permeability=5, No. 2 in Table 1) principally containing nickel oxide, zinc oxide, cobalt oxide and iron oxide. In the structure of Example 4, the magnetic material portion 41*b* is partly exposed to the exterior of the substrate 41.

In addition, a conductor 42 is provided so as to extend through both the dielectric material portion 41*a* and the magnetic material portion 41*b*, and is spirally coiled in the longitudinal direction of the substrate 41. Similar to the chip antenna 10 of Example 1, one end of the conductor 42 is drawn out to the surface of the substrate 41 in order to form a feeding section 17 connecting with a feeding terminal 16 which is provided on the surface of the substrate 41 to impress a voltage on the conductor 42. On the other hand, the other end of the conductor 42 comprises a free end 18 inside of the magnetic material portion 41*b*.

In this example, the portions comprising the substrate 41 are disposed in the order of the dielectric material portion 41*a* and the magnetic material portion 41*b*, in the longitudinal direction of the substrate 41 in relation to the feeding section 17 of the conductor 42.

Figure 9:
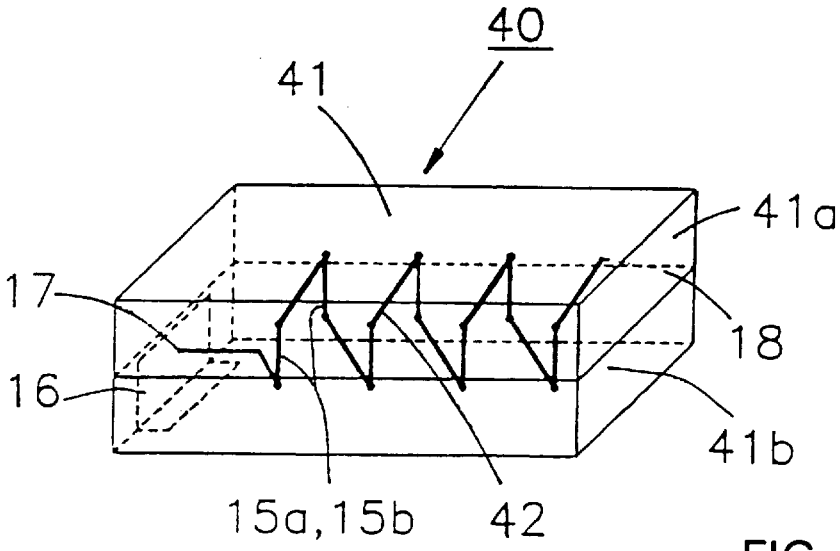
FIG. 9 is an isometric view illustrating a modified example of the chip antenna shown in FIG. 8; and, FIG. 10 is a side elevational view of a conventional chip antenna.

FIG. 9 is an isometric view illustrating a chip antenna of a modified example based on Example 4.

As compared with the chip antenna 40 of Example 4, the modified chip antenna 40*a* differs in that the portions comprising the substrate 41 are disposed in the order of the dielectric material portion 41*a* and the magnetic material portion 41*b*, in the height wise direction of the substrate 41. Also in the structure of this example, the magnetic material portion 41*b* is partly exposed to the exterior of the substrate 41. Additionally, the conductor 42 spirally coiled in the longitudinal direction of the substrate 41 is provided so as to be included in both the dielectric material portion 41*a* and the magnetic material portion 41*b*.

Table 2 shows the bandwidth ratios of the chip antennas 10, 20, 30, 30*a*, and 40 at the respective resonance frequencies, wherein the bandwidth ratios were calculated from the following equation:

Bandwidth ratio [%]=(Bandwidth [GHz]/Center frequency [GHz]) 100.

Figure 10:
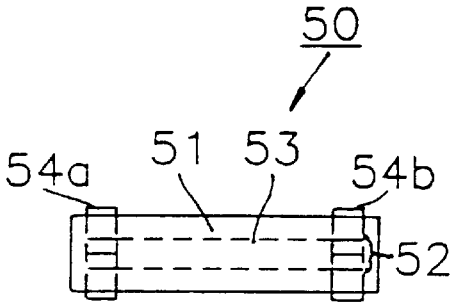
FIG. 10 PRIOR ART

The chip antennas 10, 20, 30, 30*a*, and 40 were produced so as to be available at 1.5 GHz by adjusting the turn number and the length of each of the conductors 12, 22, 32 and 42. Additionally, a conventional chip antenna 50 as shown in FIG. 10 was similarly examined for comparison.

TABLE 2

| Chip Antenna | Resonance Frequency [GHz] | Bandwidth Ratio [GHz] |
|---|---|---|
| 10 | 1.50 | 3.8 |
| 20 | 1.48 | 2.7 |
| 30 | 1.45 | 2.4 |
| 30a | 1.50 | 3.6 |
| 40 | 1.40 | 1.8 |
| | 1.50 | 2.2 |
| 50 | Not Measurable | Not Measurable |

In Table 2, "Not Measurable" means that the bandwidth ratio was 0.5% or less, or the resonance was too week to measure.

From the results shown in Table 2, it has been found that the chip antennas 10, 20, 30, 30*a* and 40 have satisfactory antenna characteristics while those of the conventional chip antenna 50 cannot be measured, namely, the conventional chip antenna 50 does not exhibit any antenna characteristics.

As described above, the chip antennas of Examples 1–4 can be used in a higher-frequency region than that in which the conventional chip antenna 50 can be used.

Further, in the above-described Examples 1 and 2, the line length of the conductor can be shortened by utilizing the wavelength-shortening effect of the dielectric material, since the conductor is provided only in the dielectric material portion of the substrate. As a result, the chip antenna can be miniaturized. Accordingly, when the miniaturized chip antenna is applied, for example, in equipment for mobile communication, the chip antenna can be built into the equipment, and in addition, the equipment itself can be miniaturized.

Additionally, since the magnetic material portion which does not contain the conductor has a radio-wave-absorbing effect, the gain decreases in the direction where the portion exists. As a result, directivity of the antenna can be controlled. In particular, when the antenna is applied in a mobile cellular phone or the like, any adverse effect of radio waves on the human body can be prevented or minimized by providing such a portion comprising a magnetic material on the side close to the human body.

Furthermore, in the above-described Example 3, the conductor is provided only in the magnetic material portion of the substrate. As a result, the inductance value of the conductor can be made large. Accordingly, the chip antenna can be miniaturized.

In addition, an impedance matching circuit can be provided in the dielectric material portion which does not contain the conductor. As a result, the bandwidth ratio can be made large.

Moreover, in the above-described Example 4, the conductor is provided so as to be contained in both the dielectric material portion and the magnetic material portion of the substrate. According to such a mode, the chip antenna can possess a combination of different antenna characteristics. As a result, a chip antenna capable of having a plurality of resonance frequencies can be obtained.

In the above-described Examples 1–4, each of the substrates comprises a portion comprising a dielectric material principally containing barium oxide, aluminum oxide and silica, and a portion comprising a material principally containing nickel oxide, zinc oxide, cobalt oxide and iron oxide. As a matter of course, the materials constituting these portions of the substrate are not limited to those compositions. The substrate may also comprise, for example, a portion comprising a dielectric material principally containing titanium oxide and neodymium oxide, and a portion comprising a magnetic material principally containing nickel oxide, cobalt oxide and iron oxide.

Though examples in which one conductor was provided were illustrated above, two or more conductors may be provided. In such a case, the chip antenna will have a plurality of resonance frequencies.

Further, though examples in which the conductor was provided inside of the substrate were illustrated above, the conductor may also be provided at least either on the surface or inside the substrate. Alternatively, the conductor may be provided by coiling a wire material such as a plated wire or an enameled wire along a spiral groove which is made on the surface of the substrate.

Moreover, though examples in which the conductor was spirally coiled were illustrated above, the conductor may have a meander shape disposed in a plane.

Furthermore, though examples in which the conductor was spirally coiled in the longitudinal direction of the substrate were illustrated above, the conductor may be spirally coiled in the heightwise direction of the substrate.

The position of the feeding terminal shown is not critical to the practice of the present invention. The feeding terminal can be disposed in various positions.

Furthermore, though a chip antenna in which the portions constituting the substrate were disposed in the order of the dielectric material portion and the magnetic material portion in the longitudinal or heightwise direction of the substrate as illustrated in the above Example 4 or in the modified example thereof, the portions may be disposed in the reverse order, e.g. the magnetic material portion and the dielectric material portion. Even in such a case, effects similar to those of Example 4 can be obtained.

Although the present invention has been described in relation to particular embodiments thereof, many other variations and modifications and other uses will become apparent to those skilled in the art. Therefore, the present invention should be limited not by the specific disclosure herein, but only by the appended claims.

What is claimed is:

1. A chip antenna comprising, a substrate comprising a dielectric material portion and a magnetic material portion, the substrate having an exterior, at least a part of said magnetic material portion comprising the exterior of the substrate;

at least one conductor disposed at least one of on a surface of the substrate and inside the substrate; and at least one feeding terminal provided on the surface of the substrate to impress a voltage on the conductor; wherein the conductor has a meandering shape disposed in a plane.

2. The chip antenna claimed in claim 1, wherein said conductor is provided only in said dielectric material portion of said substrate.

3. The chip antenna claimed in claim 1, wherein said conductor is provided only in said magnetic material portion of said substrate.

4. The chip antenna claimed in claim 1, wherein said conductor is provided in both said dielectric material portion and said magnetic material portion of said substrate.

5. The chip antenna of claim 1, wherein the substrate comprises a plurality of layers, a portion of the conductor disposed on respective ones of said layers, at least one conductive through hole provided in at least one of said layers, the layers being laminated together with the at least one through hole electrically coupling the conductor portions to form the conductor.

6. The chip antenna claimed in claim 1, wherein the substrate comprises a center dielectric material portion sandwiched between two magnetic material portions.

7. The chip antenna claimed in claim 6, wherein the conductor is disposed in said center dielectric material portion.

8. The chip antenna claimed in claim 1, wherein the magnetic material portion comprises shielding for the chip antenna to minimize radiation in a direction substantially perpendicular to a surface of the magnetic material portion.

9. The chip antenna claimed in claim 1, wherein the substrate has a longitudinal dimension defining a length, the conductor being disposed so that it extends along said length, a height of the substrate being defined perpendicular to said length.

10. The chip antenna claimed in claim 9, wherein the dielectric and magnetic material portions are disposed so as to overlie each other in the direction of the height.

11. The chip antenna claimed in claim 10, wherein the conductor is disposed in both the dielectric and magnetic material portions.

12. The chip antenna claimed in claim 9, wherein the dielectric and magnetic material portions are disposed so as to overlie each other in the direction of the length.

13. The chip antenna claimed in claim 9, wherein the conductor is disposed in both the dielectric and magnetic material portions.

14. The chip antenna claimed in claim 1, further comprising an impedance matching component coupled to the conductor.

15. The chip antenna claimed in claim 14, wherein the impedance matching component comprises a capacitor.

16. The chip antenna claimed in claim 14, wherein the impedance matching component is disposed in the dielectric material portion.

17. The chip antenna claimed in claim 14, further comprising a terminal provided on the surface of the substrate coupled to the impedance matching component.

18. The chip antenna claimed in claim 17, wherein the terminal is coupled to ground potential.

19. The chip antenna claimed in claim 1, wherein the conductor is coupled to the feeding terminal at one end and has a second free end.

20. The chip antenna claimed in claim 1, wherein the conductor is generally helically shaped.

21. The chip antenna claimed in claim 20, wherein the conductor has a generally rectangular shape in cross section.

22. The chip antenna claimed in claim 1, wherein the dielectric material portion comprises barium oxide, aluminum oxide and silica and the magnetic material portion comprises at least one of nickel oxide, zinc oxide, cobalt oxide and iron oxide.

23. The chip antenna claimed in claim 1, wherein the dielectric material portion comprises titanium oxide and neodymium oxide and the magnetic material portion comprises at least one of nickel oxide, zinc oxide, cobalt oxide and iron oxide.

24. The chip antenna claimed in claim 1, wherein the conductor is disposed on the surface of the substrate in a groove.

25. The chip antenna claimed in claim 24 wherein the groove is a spiral groove.

26. The chip antenna claimed in claim 1, wherein the substrate comprises a rectangular parallelopiped having a length, width and height, the length being greater than the width and height, the conductor being disposed so as to have a direction of extent along the length.

27. The chip antenna claimed in claim 1, wherein the substrate comprises a rectangular parallelopiped having a length, width and height, the length being greater than the width and height, the conductor being disposed so as to have a direction of extent along the height.

28. A chip antenna comprising, a substrate comprising a plurality of sheet layers stacked on each other, the substrate comprising a dielectric material portion and a magnetic material portion, the substrate having an exterior, at least a part of said magnetic material portion comprising the exterior of the substrate;

the sheet layers each having a surface, the surface of each layer establishing a stacking direction normal to the surface of each layer, the substrate comprising the plurality of sheet layers having a substrate surface;

at least one conductor disposed at least one of on the substrate surface and inside the substrate; and at least one feeding terminal provided on the substrate surface to impress a voltage on the conductor; wherein a plurality of conductive patterns are provided on respective surfaces of said sheet layers;

said conductor being formed respectively by said plurality of said conductive patterns, the conductor extending one of meanderingly and spirally perpendicular to the stacking direction of said substrate.

29. The chip antenna claimed in claim 28, wherein said conductor is provided only in said dielectric material portion of said substrate.

30. The chip antenna claimed in claim 28, wherein said conductor is provided only in said magnetic material portion of said substrate.

31. The chip antenna claimed in claim 28, wherein said conductor is provided in both said dielectric material portion and said magnetic material portion of said substrate.

32. The chip antenna of claim 28, wherein a portion of the conductor is disposed on respective ones of said layers, at least one conductive through hole provided in at least one of said layers, the layers being laminated together with the at least one through hole electrically coupling the conductor portions to form the conductor.

33. The chip antenna claimed in claim 28, wherein the substrate comprises a center dielectric material portion sandwiched between two magnetic material portions.

34. The chip antenna claimed in claim 33, wherein the conductor is disposed in said center dielectric material portion.

35. The chip antenna claimed in claim 28, wherein the magnetic material portion comprises shielding for the chip antenna to minimize radiation in a direction substantially perpendicular to a surface of the magnetic material portion.

36. The chip antenna claimed in claim 28, wherein the substrate has a longitudinal dimension defining a length, the conductor being disposed so that it extends along said length, a height of the substrate being defined perpendicular to said length.

37. The chip antenna claimed in claim 36, wherein the dielectric and magnetic material portions are disposed so as to overlie each other in the direction of the height.

38. The chip antenna claimed in claim 37, wherein the conductor is disposed in both the dielectric and magnetic material portions.

39. The chip antenna claimed in claim 36, wherein the dielectric and magnetic material portions are disposed so as to overlie each other in the direction of the length.

40. The chip antenna claimed in claim 36, wherein the conductor is disposed in both the dielectric and magnetic material portions.

41. The chip antenna claimed in claim 28, further comprising an impedance matching component coupled to the conductor.

42. The chip antenna claimed in claim 41, wherein the impedance matching component comprises a capacitor.

43. The chip antenna claimed in claim 41, wherein the impedance matching component is disposed in the dielectric material portion.

44. The chip antenna claimed in claim 41, further comprising a terminal provided on the surface of the substrate coupled to the impedance matching component.

45. The chip antenna claimed in claim 44, wherein the terminal is coupled to ground potential.

46. The chip antenna claimed in claim 28, wherein the conductor is coupled to the feeding terminal at one end and has a second free end.

47. The chip antenna claimed in claim 28, wherein the conductor is generally helically shaped.

48. The chip antenna claimed in claim 47, wherein the conductor has a generally rectangular shape in cross section.

49. The chip antenna claimed in claim 28, wherein the dielectric material portion comprises barium oxide, aluminum oxide and silica and the magnetic material portion comprises at least one of nickel oxide, zinc oxide, cobalt oxide and iron oxide.

50. The chip antenna claimed in claim 28, wherein the dielectric material portion comprises titanium oxide and neodymium oxide and the magnetic material portion comprises at least one of nickel oxide, zinc oxide, cobalt oxide and iron oxide.

51. The chip antenna claimed in claim 28, wherein the conductor is disposed on the surface of the substrate in a groove.

52. The chip antenna claimed in claim 51, wherein the groove is a spiral groove.

53. The chip antenna claimed in claim 30, wherein the conductor comprises a spiral.

54. The chip antenna claimed in claim 30, wherein the conductor has a meandering shape disposed in a plane.

55. The chip antenna claimed in claim 30, wherein the substrate comprises a rectangular parallelopiped having a length, width and height, the length being greater than the width and height, the conductor being disposed so as to have a direction of extent along the length.

56. The chip antenna claimed in claim 30, wherein the substrate comprises a rectangular parallelopiped having a length, width and height, the length being greater than the width and height, the conductor being disposed so as to have a direction of extent along the height.

* * * * *